US008406444B2

(12) United States Patent
Wang

(10) Patent No.: US 8,406,444 B2
(45) Date of Patent: Mar. 26, 2013

(54) AUDIO RADIATION TYPE REFLECTIVE SOUND BOX STRUCTURE

(76) Inventor: Chao-Lang Wang, Xizhi (TW)

( * ) Notice: Subject to any disclaimer, the term of this patent is extended or adjusted under 35 U.S.C. 154(b) by 324 days.

(21) Appl. No.: 12/805,355

(22) Filed: Jul. 27, 2010

(65) Prior Publication Data

US 2011/0235845 A1 Sep. 29, 2011

(30) Foreign Application Priority Data

Mar. 25, 2010 (TW) ..... 99108897 A

(51) Int. Cl.
*H04R 1/02* (2006.01)
*H04R 25/00* (2006.01)

(52) U.S. Cl. ..... 381/335; 381/333; 381/336; 381/345

(58) Field of Classification Search ..... 381/333, 381/345, 335–338, 386, 351, 352
See application file for complete search history.

(56) References Cited

U.S. PATENT DOCUMENTS

| | | | | |
|---|---|---|---|---|
| 2,731,101 | A * | 1/1956 | Klipsch | 181/148 |
| 3,037,081 | A * | 5/1962 | Carlsson | 381/336 |
| 4,949,386 | A * | 8/1990 | Hill | 381/349 |
| 5,189,706 | A * | 2/1993 | Saeki | 381/349 |
| 5,432,860 | A * | 7/1995 | Kasajima et al. | 381/349 |
| 5,620,101 | A | 4/1997 | Andela | |
| 5,944,268 | A | 8/1999 | Andela | |
| 6,104,823 | A * | 8/2000 | Tanaka | 381/345 |
| 6,144,751 | A * | 11/2000 | Velandia | 381/345 |
| 6,356,643 | B2 * | 3/2002 | Yamagishi et al. | 381/349 |
| 6,560,343 | B1 * | 5/2003 | Kim | 381/349 |
| 6,628,797 | B2 * | 9/2003 | Yamada | 381/345 |
| 6,658,127 | B1 * | 12/2003 | Kim | 381/340 |
| 6,744,902 | B2 * | 6/2004 | Proni | 381/386 |
| 6,751,330 | B2 * | 6/2004 | Kowaki et al. | 381/354 |
| 7,006,648 | B2 * | 2/2006 | Wang | 381/336 |
| 7,010,138 | B1 * | 3/2006 | Harris et al. | 381/337 |
| 7,178,628 | B2 * | 2/2007 | Gordon | 181/153 |
| 7,413,602 | B2 | 8/2008 | Grasso et al. | |
| 7,506,721 | B2 * | 3/2009 | Moore | 181/156 |
| 7,925,036 | B2 * | 4/2011 | Bouvier | 381/345 |
| 8,073,177 | B2 * | 12/2011 | Tsai | 381/349 |
| 8,111,836 | B1 * | 2/2012 | Graber | 381/71.7 |
| 2006/0029241 | A1 * | 2/2006 | Graber | 381/182 |
| 2007/0058830 | A1 * | 3/2007 | Setiabudi et al. | 381/349 |
| 2007/0064958 | A1 * | 3/2007 | Nakamura | 381/71.1 |
| 2007/0223762 | A1 * | 9/2007 | Kwon et al. | 381/334 |
| 2009/0003639 | A1 * | 1/2009 | Aylward | 381/349 |
| 2011/0158447 | A1 * | 6/2011 | Bouvier | 381/338 |
| 2011/0235845 | A1 * | 9/2011 | Wang | 381/386 |
| 2012/0014555 | A1 * | 1/2012 | Shim | 381/396 |
| 2012/0063630 | A1 * | 3/2012 | Maezawa et al. | 381/386 |

* cited by examiner

*Primary Examiner* — David S. Warren
(74) *Attorney, Agent, or Firm* — Bacon & Thomas, PLLC

(57) ABSTRACT

An audio radiation type reflective sound box structure comprises a hollow cone tube having a first end received in a box, a second end extended out of an opening of the box to form an inclined side wall, and at least one vent disposed adjacent to the first end. When a diaphragm of a speaker mounted on an inner side edge of the second end generates vibrations, compressed air in the hollow cone tube is pushed out of the opening through the vent, and then collides with the outer edge of the inclined side wall and is diffused toward a peripheral direction adjacent to a front side of the speaker along an extension direction of the inclined side wall. Thus, the sounds reflected by the box can be evenly transmitted to a peripheral environment adjacent to the front side of the speaker.

16 Claims, 7 Drawing Sheets

AUDIO RADIATION TYPE REFLECTIVE SOUND BOX STRUCTURE

FIELD OF THE INVENTION

The present invention relates to a sound box structure, more particularly to an audio radiation type reflective sound box structure comprising a hollow cone tube and a box, wherein the hollow cone tube has a first end received in a receiving space of the box, a second end extended out of an opening of the box to form an inclined side wall, at least one vent adjacent to the first end, and a speaker mounted on an inner side edge of the second end. When a diaphragm of the speaker generates vibrations, compressed air in the hollow cone tube is pushed out of the opening through the vent, and then collides with the outer edge of the inclined side wall and is diffused toward a peripheral direction adjacent to a front side of the speaker along an extension direction of the inclined side wall. Thus, the sounds reflected by the box can be evenly transmitted to a peripheral environment adjacent to the front side of the speaker, so that users located both at the front side and in the peripheral environment of the speaker can clearly hear the sounds played by the sound box structure.

BACKGROUND OF THE INVENTION

Recently, with the development of technologies, various electronic devices, such as portable audio, mobile phone, notebook computer, voice navigation device, handheld game console, etc., are rapidly developed day by day, while there is gradually a trend to achieve the miniaturization and compactness of the electronic devices. Therefore, users can conveniently carry various electronic devices to enjoy various functions provided by the electronic devices at any time.

As described above, the main design target of various electronic devices is to carry out the miniaturization and compactness thereof. Meanwhile, for matching with the design of an electronic device, the volume of a speaker box installed in the electronic device must be substantially reduced. However, the performance of a speaker in the speaker box is limited to the reduced size of the speaker box, so that sounds played by the speaker have a relatively high directivity. As a result, when users located at different positions use the speaker box installed in the electronic device and listen to sound played by the speaker box, only users located at a front side of the speaker box can clearly hear the sound, while users located otherwise are typically not enabled to hear clear sounds. Therefore, it is important for related manufacturers of speakers to think how to maintain the size of a speaker and to optimize the sound quality, sound volume and directivity of a speaker box, for the purpose of meeting the design trend of modern electronic devices and providing best playing effect to the users.

Referring now to FIG. 1, a traditional small sound box structure is illustrated and described hereinafter, wherein the sound box structure 1 comprises a box body 11 and at least one speaker 13. The box body 11 is formed with a receiving space 110 therein and at least one speaker mounting hole 111 on one side thereof. The number of the speaker mounting hole 111 is matched with that of the speaker 13. Furthermore, the speaker 13 comprises a frame body 131 which has a side periphery adjacent to a diaphragm 133, and the side periphery thereof is mounted on the speaker mounting hole 111, so that the speaker 13 can be stably mounted on the box body 11. Moreover, the frame body 131, a voice coil 135 and a magnetic member 137 are received in the receiving space 110.

When the speaker 13 is driven, the diaphragm 133 can vibrate to generate sounds which are then transmitted out of the box body 11.

As described above, referring still to FIG. 1, when the speaker 13 is driven, current of audio source signals passes through the voice coil 135, and then the voice coil 135 is energized to generate an electro-magnetic effect, wherein the magnetic line of force generated by the voice coil 135 and that generated by the magnetic member 137 around the voice coil 135 can generate attractive and repulsive forces therebetween. Thus, according to variation of strength and direction of the current of audio source signals, the diaphragm 133 can be actuated to generate reciprocal vibrations, so that the speaker 13 will generate sounds. However, the size of the speaker 13 installed in various electronic devices is generally smaller. When the speaker 13 is driven and the diaphragm 133 starts to vibrate, the air in the box body 11 can be simultaneously compressed or expanded. However, the box body 11 is limited to the inner design of the receiving space 110 and a planar panel on an edge of the one side thereof, so that sounds played by the sound box structure 1 have a relatively high directivity, resulting in limiting a speaker angle of the sounds. Especially, high frequency sounds are seriously limited, so that users located at the periphery other than the front side of the sound box structure 1 can not clearly hear the high frequency sounds.

As a result, it is an important issue for the present invention to think how to design an improved sound box structure to solve the foregoing problems of the traditional sound box structure for efficiently lowering the directivity of sounds played by the sound box structure and strengthening the entire sound diffusion effect thereof, so that all of users located at different positions with respect to the sound box structure can clearly hear the played sounds.

It is therefore tried by the inventor to develop an audio radiation type reflective sound box structure to solve the problems existing in the conventional sound box structure, so that users can hear clearer and louder sounds and fully enjoy the excellent full-frequency effect of the sound box structure when the users listen to sounds played by the sound box structure.

BRIEF SUMMARY OF THE INVENTION

A primary object of the present invention is to provide an audio radiation type reflective sound box structure, which comprises a box, a hollow cone tube and at least one speaker. The box is provided with an opening on an upper portion thereof and a receiving space therein. The hollow cone tube has a first end received in the receiving space and a second end extended out of the opening, while a predetermined distance is defined between an inner side surface of the box and an outer side surface of the hollow cone tube, so as to form an airflow guiding space between the box and the hollow cone tube. The hollow cone tube is further formed with at least one vent adjacent to the first end and a speaker mounting hole extended inward from an inner side edge of the second end. The speaker is installed and mounted on the speaker mounting hole, and received in the hollow cone tube, so that the opening, the airflow guiding space, the vent and the speaker mounting hole can be communicated with each other. The second end of the hollow cone tube has an outer side edge extended outward to form an inclined side wall, wherein a first guiding angle is included between an outer edge tangent line of the inclined side wall and a central line of the hollow cone tube, while a predetermined gap is defined between an outer edge of the second end of the hollow cone tube and an edge of the opening of the box. Therefore, when a diaphragm of the speaker generates vibrations, compressed air in the hollow cone tube is pushed out of the opening through the vent and the airflow guiding space, and passed through the gap to collide with the outer edge of the inclined side wall, followed by being diffused toward a peripheral direction adjacent to a front side of the speaker along an extension direction of the inclined side wall. Thus, the sound box structure allows the speaker to precisely and directly generate sounds in the front side of the speaker, while the sounds reflected in the box can be evenly transmitted to a peripheral environment adjacent to the front side of the speaker through the first guiding angle of the inclined side wall and the gap between the outer edge of the second end of the hollow cone tube and the edge of the opening of the box. As a result, the directivity of the sounds generated by the sound box structure can be substantially lowered, so that users located both at the front side and in the peripheral environment of the speaker of the sound box structure can clearly hear the sounds played by the sound box structure.

BRIEF DESCRIPTION OF THE SEVERAL VIEWS OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE INVENTION

Figure 1:
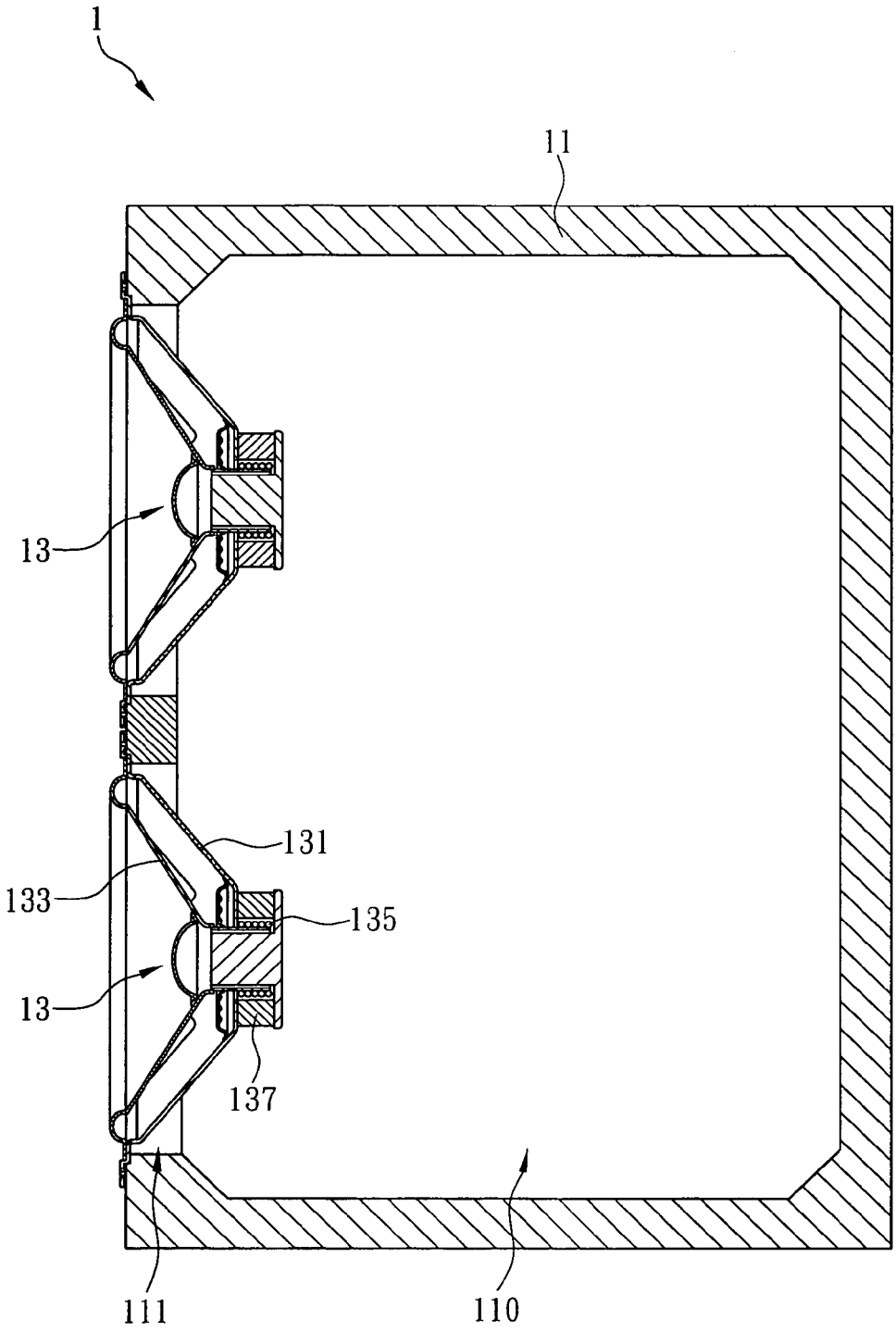
FIG. 1 (Prior Art)
FIG. 1 is an assembled cross-sectional view of a traditional sound box structure.
Figure 2:
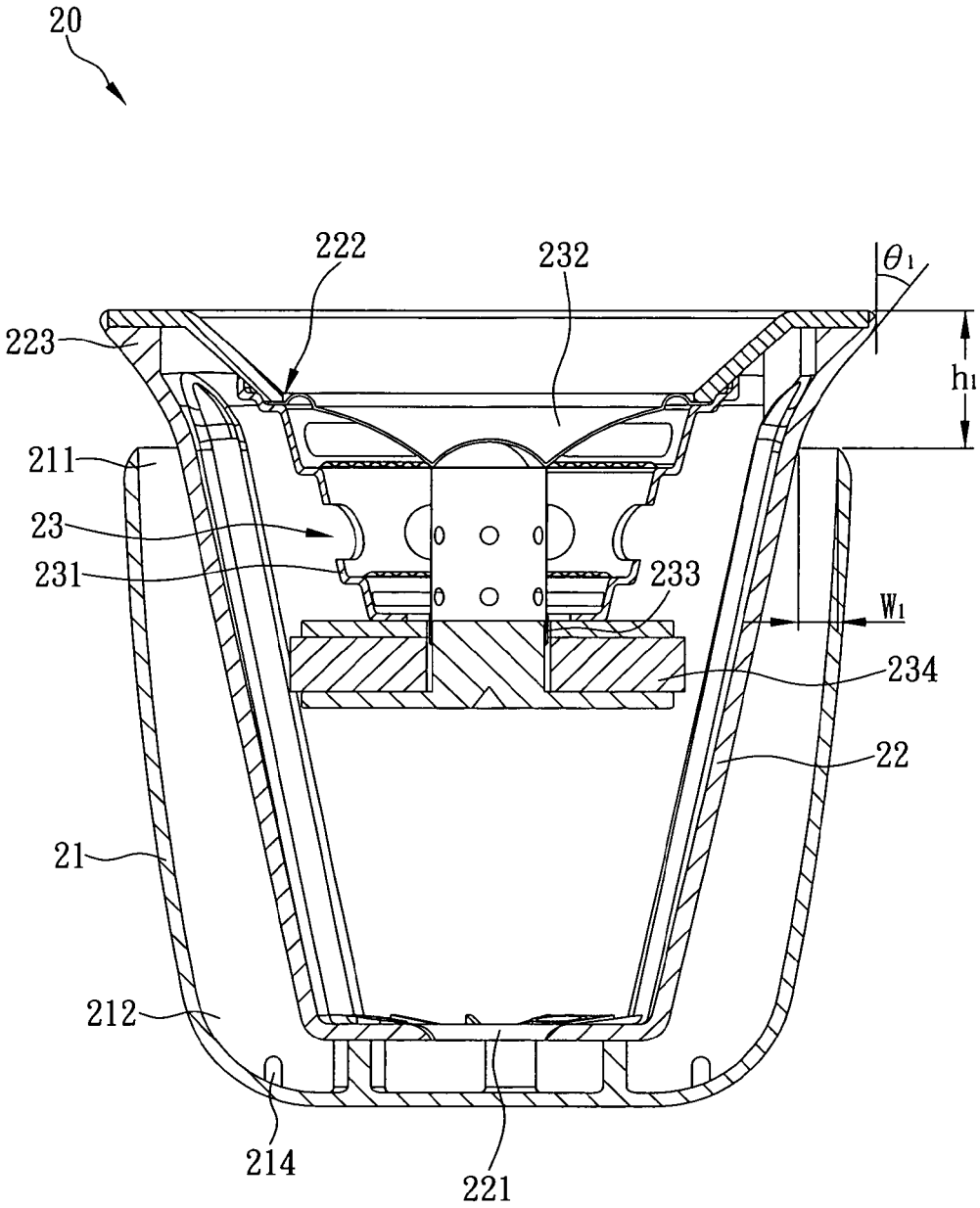
FIG. 2 is an assembled cross-sectional view of an audio radiation type reflective sound box structure according to a first preferred embodiment of the present invention.

The present invention is an audio radiation type reflective sound box structure. Referring now to FIG. 2, a sound box structure designated by numeral 20 comprises a box 21, a hollow cone tube 22 and at least one speaker 23, wherein the box 21 is provided with an opening 211 on an upper portion thereof and a receiving space 212 therein. The hollow cone tube 22 has a first end received in the receiving space 212 and a second end extended out of the opening 211, while a predetermined distance W1 is defined between an inner side surface of the box 21 and an outer side surface of the hollow cone tube 22, so as to form an airflow guiding space (unlabeled) between the box 21 and the hollow cone tube 22. The hollow cone tube 22 is further formed with at least one vent 221 adjacent to the first end and a speaker mounting hole 222 extended inward from an inner side edge of the second end. Thus, the speaker 23 is installed and mounted on the speaker mounting hole 222, and received in the hollow cone tube 22, so that the opening 211, the airflow guiding space, the vent 221 and the speaker 23 can be communicated with each other. The second end of the hollow cone tube 22 has an outer side edge extended outward to form an inclined side wall 223, wherein a first guiding angle θ1 is included between an outer edge tangent line of the inclined side wall 223 and a central line of the hollow cone tube 22. In the embodiment, the first guiding angle θ1 is preferably ranged from 30 to 45 degree. Meanwhile, a predetermined gap h1 is defined between an outer edge of the second end of the hollow cone tube 22 and an edge of the opening 211 of the box 21.

Furthermore, the speaker 23 comprises a frame body 231, a diaphragm 232, a voice coil 233 and a magnetic member 234, wherein a first side edge of the frame body 231 is mounted on the speaker mounting hole 222, so that the speaker 23 can be received in the hollow cone tube 22. In addition, an outer side edge of the diaphragm 232 is attached to an inner side edge of the frame body 231, and a central position of an inner edge of the diaphragm 232 is connected to the voice coil 233. The magnetic member 234 is installed on a second side edge of the frame body 231 and surrounding a periphery of the voice coil 233. Moreover, the frame body 231, the voice coil 233 and the magnetic member 234 are received in the hollow cone tube 22. When the speaker 23 is driven, the vibrations of the diaphragm 232 can vibrate the ambient air in the front side of the sound box structure 20, so as to transmit sounds out of the sound box structure 20.

Figure 3A:
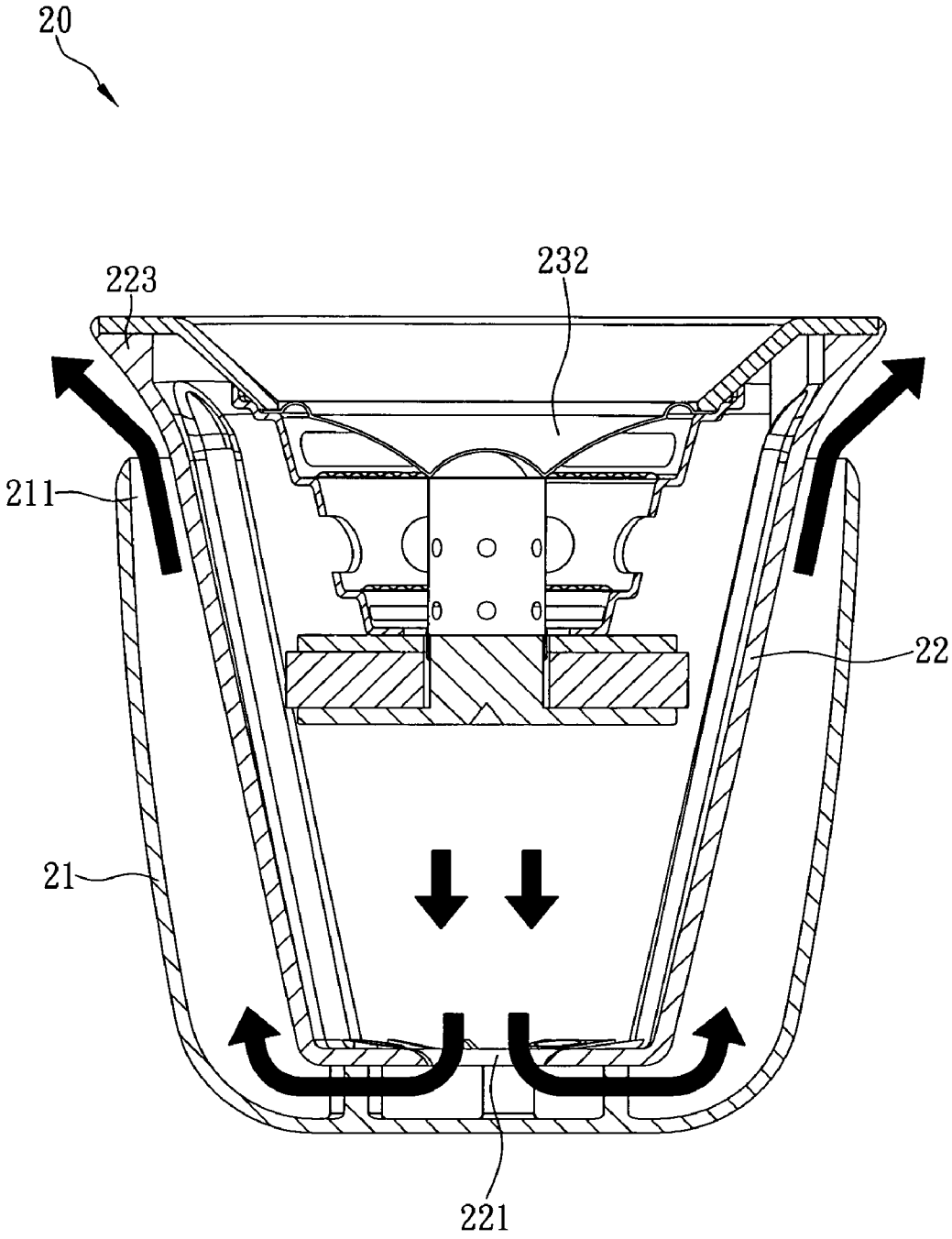
FIG. 3A is an operational view of the audio radiation type reflective sound box structure according to the first preferred embodiment of the present invention.

Therefore, when the speaker 23 is driven, the diaphragm 232 of the speaker 23 can generate vibrations, and then the air in the hollow cone tube 22 will be compressed or generate a vacuum effect, so that the air will be vibrated. As shown in FIGS. 2 and 3A, when the compressed air in the hollow cone tube 22 is diffused downward along a vibration direction of the diaphragm 232, the air in the hollow cone tube 22 will be pushed into the airflow guiding space through the vent 221, and then pushed out of the opening 211 through the airflow guiding space, followed by being collided with the outer edge of the inclined side wall 223. Because a first guiding angle θ1 is included between the outer edge tangent line of the inclined side wall 223 and the central line of the hollow cone tube 22, the original airflow direction of the air collided with the outer edge of the inclined side wall 223 will be changed and then the air will be diffused toward a peripheral direction adjacent to the front side of the speaker 23 along an extension direction of the inclined side wall 223. Thus, the sound box structure 20 allows the speaker 23 to precisely and directly generate sounds in the front side of the speaker 23, while the sounds reflected in the box 21 can be evenly transmitted to a peripheral environment adjacent to the front side of the speaker 23 through the first guiding angle θ1 of the inclined side wall 223 and the gap h1 between the outer edge of the second end of the hollow cone tube 22 and the edge of the opening 211 of the box 21. As a result, the directivity of the sounds generated by the sound box structure 20 can be substantially lowered, while the entire sound diffusion effect thereof can be strengthened, so that users located both at the front side and in the peripheral environment of the speaker 23 of the sound box structure 20 can clearly hear the sounds played by the sound box structure 20. Thus, it can efficiently solve the problem existing in the traditional sound box structure which generates sounds with too high directivity to cause that users located at the periphery other than the front side of the sound box structure can not clearly hear the sounds.

Figure 3B:
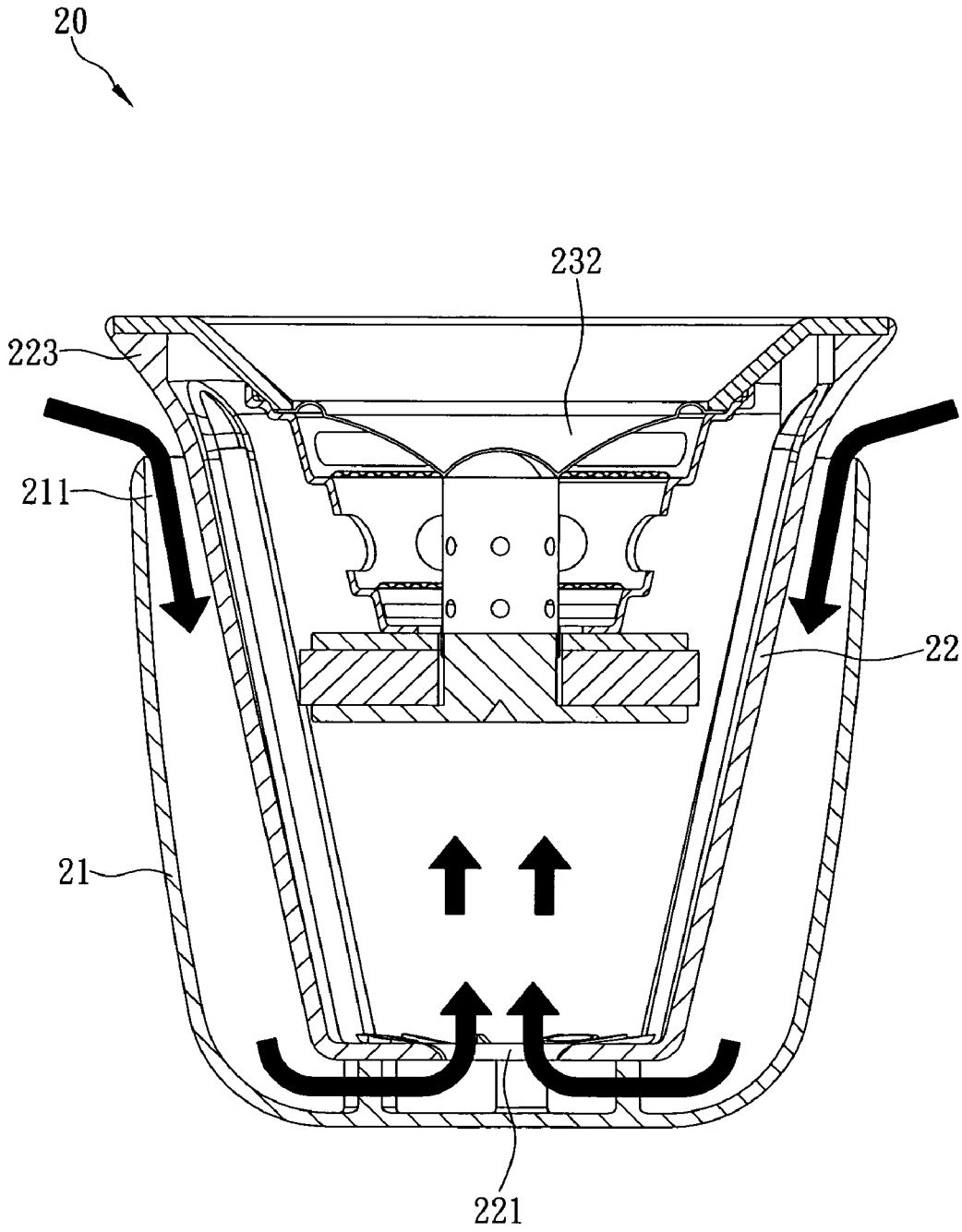
FIG. 3B is another operational view of the audio radiation type reflective sound box structure according to the first preferred embodiment of the present invention.

Referring now to FIG. 3B, when the air in the hollow cone tube 22 is contracted upward along the vibration direction of the diaphragm 232, the air outside the sound box structure 20 can be diffused into the airflow guiding space through the opening 211 of the box 21, and then diffused into the hollow cone tube 22 through the vent 221. Thus, as shown in FIGS. 3A and 3B, no matter when the air in the hollow cone tube 22 is pushed into the airflow guiding space through the vent 221 and then pushed out of the sound box structure 20 through the opening 211 or when the air outside the sound box structure 20 can be diffused into the airflow guiding space through the opening 211 of the box 21 and then diffused into the hollow cone tube 22 through the vent 221, the compressed or diffused air in the hollow cone tube 22 can obtain sufficient release space to efficiently decrease the reactive force generated by the compressed air in the hollow cone tube 22 against the diaphragm 232 of the speaker 23 and to increase the active force generated by the diffused air in the hollow cone tube 22 against the diaphragm 232 of the speaker 23. As a result, the diaphragm 232 can vibrate more smoothly, so as to strengthen the entire low-frequency sound effect of the sound box structure 20. Moreover, in other embodiments of the present invention, the appearance of the box 21 may be selectively rectangular, oval shaped, polygonal or other curved shapes, without limitation.

In addition, referring back to FIG. 2, in the preferred embodiment, an inner side bottom of the box 21 is further provided with a plurality of light emitting elements 214, such as LEDs, halogen bulbs, incandescent bulbs, etc. The light emitting elements 214 can receive an external power to emit light in the box 21, wherein the brightness and color of the light can be varied according to the sound scale or other factors (such as sound volume, frequency or rhythms) of the sounds generated by the speaker 23. Meanwhile, an inner side surface of the box 21 and an outer side surface of the hollow cone tube 22 can be made of smooth reflective material, so as to reflect the light emitted by the light emitting elements 214 out of the opening 211 through the airflow guiding space. Thus, when the sound box structure 20 plays the sounds, the users can enjoy a visual lighting effect provided by the sounds and the light. In other embodiments of the present invention, the light emitting elements 214 may be selectively mounted on the outer side surface of the hollow cone tube 22, the inner side surface of the box 21 or an outer side surface of the box 21. The locations of the light emitting elements 214 are not limited to the inner side bottom of the box 21.

Figure 4:
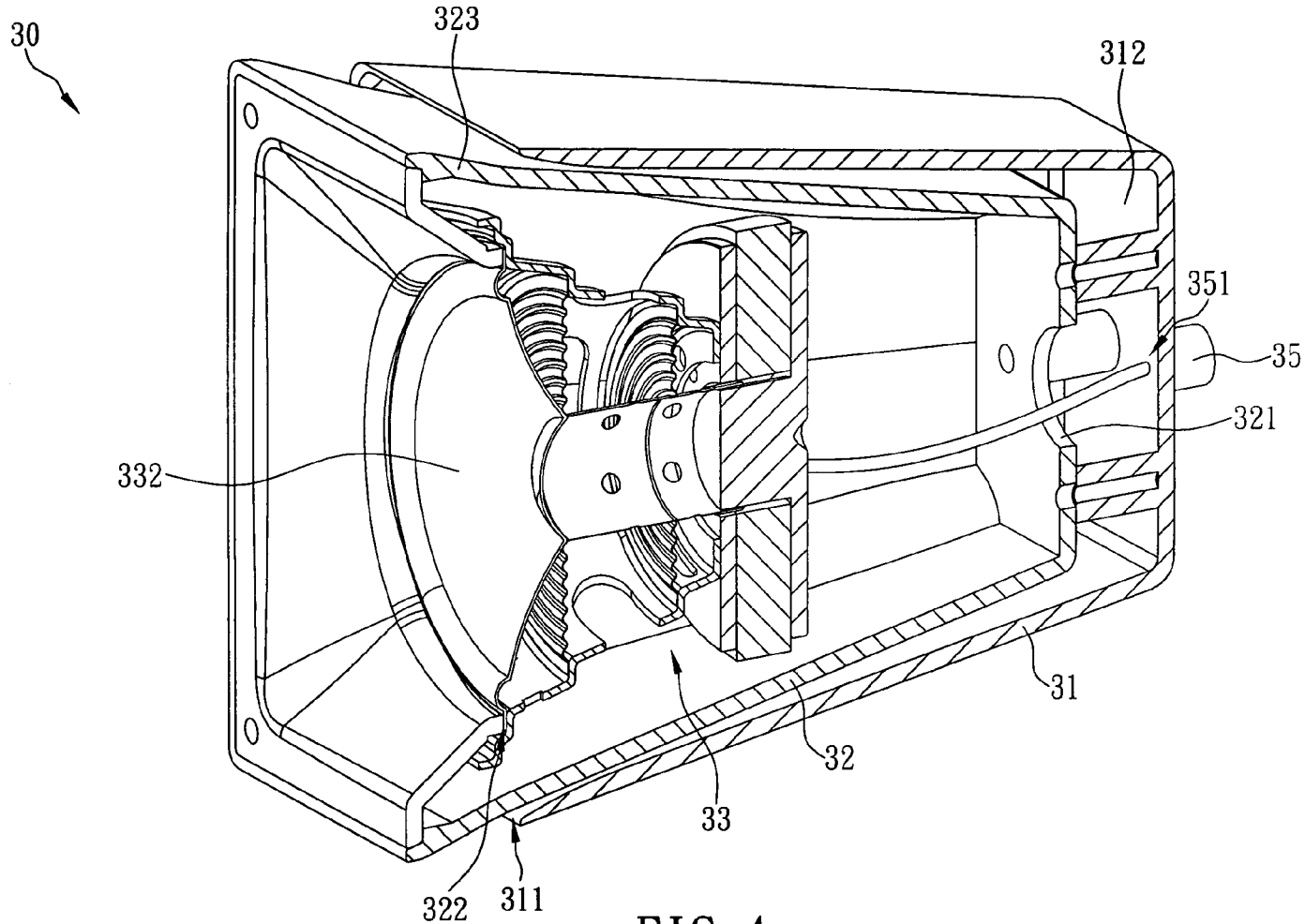
FIG. 4 is a perspective cross-sectional view of an audio radiation type reflective sound box structure according to a second preferred embodiment of the present invention.

Referring now FIG. 4, in a second preferred embodiment of the present invention, a sound box structure 30 comprises a box 31, a hollow cone tube 32, at least one speaker 33 and an input terminal 35, wherein the box 31 is provided with an opening 311 on an upper portion thereof and a receiving space 312 therein. The hollow cone tube 32 is formed with at least one vent 321 adjacent to a first end thereof and a speaker mounting hole 322 extended inward from an inner side edge of a second end thereof. Thus, the speaker 33 is installed and mounted on the speaker mounting hole 322, and received in the hollow cone tube 32. The second end of the hollow cone tube 32 has an outer side edge extended outward to form an inclined side wall 323, wherein a first guiding angle (unlabeled) is included between an outer edge tangent line of the inclined side wall 323 and a central line of the hollow cone tube 32. The first end of the hollow cone tube 32 is received in the receiving space 312 and the second end thereof is extended out of the opening 311, while a predetermined distance (unlabeled) is defined between an inner side surface of the box 31 and an outer side surface of the hollow cone tube 32, so as to form an airflow guiding space (unlabeled) between the box 31 and the hollow cone tube 32, so that the opening 311, the airflow guiding space, the vent 321 and the speaker 33 can be communicated with each other. Meanwhile, a predetermined gap (unlabeled) is defined between an outer edge of the second end of the hollow cone tube 32 and an edge of the opening 311 of the box 31. The speaker 33 is installed and mounted on the speaker mounting hole 322, and received in the second end of the hollow cone tube 32. When the speaker 33 is driven, the vibrations of the diaphragm 332 can vibrate the ambient air in the front side of the sound box structure 30, so that the airflow direction can be changed by an outer edge of the inclined side wall 323, and then the air will be diffused to the front side and a peripheral environment of the sound box structure 30 along an extension direction of the inclined side wall 323. Thus, the sounds can be evenly transmitted to the front side and the peripheral environment of the sound box structure 30, so as to lower the directivity of the sounds generated by the sound box structure 30 and to strengthen the entire sound diffusion effect thereof. As a result, users located both at the front side and in the peripheral environment of the sound box structure 30 can clearly hear the sounds played by the sound box structure 30. In addition, the input terminal 35 is mounted on the box 31. In the embodiment, the input terminal 35 is mounted on an outer side surface of the box 31. The input terminal 35 is electrically connected to the speaker 33 through a wire 351, so as to transmit signals of an external sound source to the speaker 33.

Figure 5:
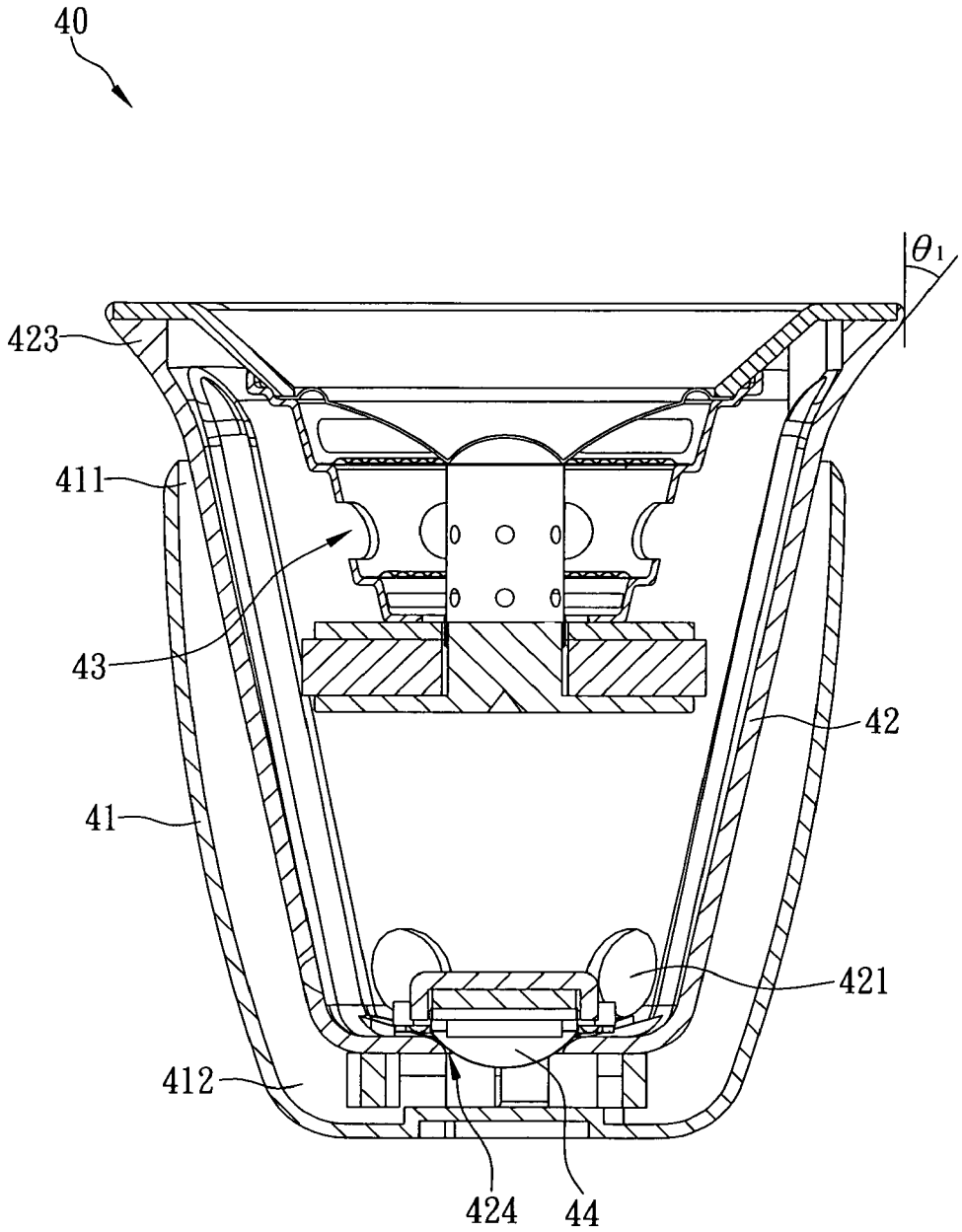
FIG. 5 is an assembled cross-sectional view of an audio radiation type reflective sound box structure according to a third preferred embodiment of the present invention.

Referring now FIG. 5, in a third preferred embodiment of the present invention, a hollow cone tube 42 of a sound box structure 40 has a first end received in a receiving space 412 of a box 41, wherein the first end is formed with a second speaker mounting hole 424 thereon, so that a second speaker 44 can be mounted on the second speaker mounting hole 424 of the first end of the hollow cone tube 42. In the embodiment, the second speaker 44 is a tweeter. The first end of the hollow cone tube 42 is further formed with at least one vent 421 adjacent to the second speaker mounting hole 424, wherein the vent 421 is communicated with an airflow guiding space (unlabeled) and an opening 411. The hollow cone tube 42 further has a second end, wherein an outer side edge of the second end is extended outward to form an inclined side wall 423, and a first guiding angle θ1 is included between an outer edge tangent line of the inclined side wall 423 and a central line of the hollow cone tube 42. Therefore, when a first speaker 43 is driven, the first speaker 43 can vibrate the air in the hollow cone tube 42, so that the air therein will be compressed or generate a vacuum effect. Then, the air is pushed into the airflow guiding space through the vent 421, and pushed out of the opening 411 through the airflow guiding space, followed by being collided with the outer edge of the inclined side wall 423. After this, the air will be diffused toward a front side and a peripheral environment of the first speaker 43 along an extension direction of the inclined side wall 423. Thus, the sounds generated by the first speaker 43 of the sound box structure 40 can be evenly transmitted to the front side and the peripheral environment of the sound box structure 40. On the other hand, when the second speaker 44 is driven, the second speaker 44 can vibrate the air in the airflow guiding space between an outer side surface of the hollow cone tube 42 and an inner side surface of the box 41, so that the air in the airflow guiding space is pushed out of the opening 411 and collided with the outer edge of the inclined side wall 423. After this, the air will be diffused toward the front side and the peripheral environment of the sound box structure 40 along an extension direction of the inclined side wall 423. Thus, the sounds generated by the second speaker 44 of a sound box structure 40 can be evenly transmitted to the front side and the peripheral environment of the sound box structure 40.

Figure 6:
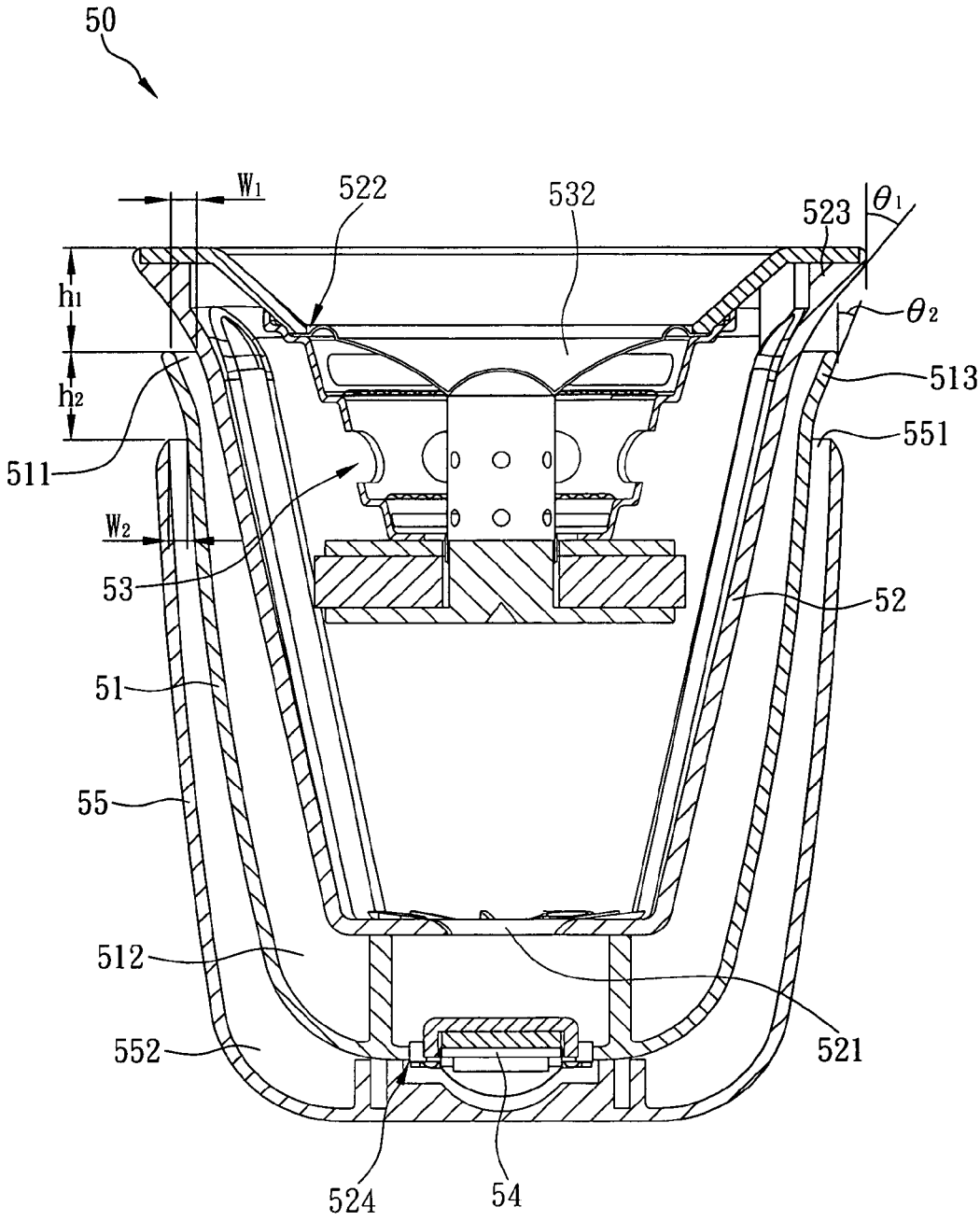
FIG. 6 is an assembled cross-sectional view of an audio radiation type reflective sound box structure according to a fourth preferred embodiment of the present invention.

Referring now FIG. 6, in a fourth preferred embodiment of the present invention, a sound box structure 50 comprises a first box 51, a hollow cone tube 52, at least one speaker 53 and a second box 55, wherein the first box 51 is provided with a first opening 511 on an upper portion thereof, a first receiving space 512 therein, and a second speaker mounting hole 524 on a bottom thereof, wherein a second speaker 54 can be mounted on the bottom of the first box 51. In the embodiment, the second speaker 54 can be a tweeter. An outer side edge of the upper portion of the first box 51 is extended outward to form a second inclined side wall 513, wherein a second guiding angle θ2 is included between an outer edge tangent line of the second inclined side wall 513 and a central line of the hollow cone tube 52. The hollow cone tube 52 has a first end received in the first receiving space 512 of the first box 51 and a second end extended out of the first opening 511, while a first predetermined distance W1 is defined between an inner side surface of the first box 51 and an outer side surface of the hollow cone tube 52, so as to form a first airflow guiding space (unlabeled) between the first box 51 and the hollow cone tube 52. The hollow cone tube 52 is further formed with at least one vent 521 adjacent to the first end and a first speaker mounting hole 522 extended inward from an inner side edge of the second end. Thus, the speaker 53 is installed and mounted on the first speaker mounting hole 522, and received in the hollow cone tube 52. An outer side edge of the second end of the hollow cone tube 52 is extended outward to form a first inclined side wall 523, and a first guiding angle θ1 is included between an outer edge tangent line of the inclined side wall 523 and a central line of the hollow cone tube 52, while a first predetermined gap h1 is defined between an outer edge of the second end of the hollow cone tube 52 and an edge of the first opening 511 of the first box 51. The second box 55 is provided with a second opening 551 on an upper portion thereof and a second receiving space 552 therein. The second box 55 is sleeved on the first box 51 and connected to the bottom of the first box 51, i.e. the bottom of the first box 51 is received in the second receiving space 552 of the second box 55. Furthermore, an upper portion of the first box 51 is protruded out of the second opening 551 of the second box 55, so that a second predetermined gap h2 is defined between an edge of the second opening 551 of the second box 55 and the edge of the first opening 511 of the first box 51, while a second predetermined distance W2 is defined between an inner side surface of the second box 55 and an outer side surface of the first box 51, so as to form a second airflow guiding space (unlabeled) between the second box 55 and the first box 51. Therefore, when the first speaker 53 and the second speaker 54 are driven, the first speaker 53 can vibrate the air in the hollow cone tube 52, so that the air therein will be pushed into the first airflow guiding space through the vent 521, and pushed out of the first opening 511 through the first airflow guiding space, followed by being collided with the outer edge of the first inclined side wall 523. After this, the air will be diffused toward a front side and a peripheral environment of the sound box structure 50 along an extension direction of the first inclined side wall 523. Meanwhile, the second speaker 54 can vibrate the air in the second airflow guiding space between the outer side surface of the first box 51 and the inner side surface of the second box 55, so that the air therein will be pushed out of the second opening 551 through the second airflow guiding space, followed by being collided with the outer edge of the second inclined side wall 513. After this, the air will be diffused toward the front side and the peripheral environment of the sound box structure 50 along an extension direction of the second inclined side wall 513. Thus, sounds with different high and low frequencies generated by the first speaker 53 and the second speaker 54 of the same sound box structure 50 can be evenly transmitted to the front side and the peripheral environment of the sound box structure 50 along the extension directions of the first inclined side wall 523 and the second inclined side wall 513, respectively, i.e. the sounds with different high and low frequencies generated by the first speaker 53 and the second speaker 54 can be diffused out of the sound box structure 50 through different pathways (e.g. first and second airflow guiding spaces) without interfering with each other. As a result, the directivity of the sounds generated by the sound box structure 50 can be substantially lowered, so that users located both at the front side and in the peripheral environment of the sound box structure 50 can clearly hear the sounds played by the sound box structure 50. In addition, if necessary, the second speaker 54 of the fourth preferred embodiment and the second speaker 44 of the third preferred embodiment may be selected from a compression driver.

As described above, the present invention is not limited to terms and descriptions used by the foregoing preferred embodiments, such as locations of the box, the first box, the second box, the speaker, the first speaker, the second speaker and the vent, angles of the first guiding angle and the second guiding angle etc. It is understood that many changes and modifications to the described embodiment can be carried out without departing from the scope and the spirit of the invention that is intended to be limited only by the appended claims.

What is claimed is:

1. An audio radiation type reflective sound box structure, comprising:

a first box provided with a first opening on an upper portion thereof and a first receiving space therein;

a hollow cone tube having a first end received in the first receiving space and a second end extended out of the first opening, a first predetermined distance being defined between an inner side surface of the first box and an outer side surface of the hollow cone tube, so as to form a first airflow guiding space between the first box and the hollow cone tube; the hollow cone tube being further formed with at least one vent adjacent to the first end and a first speaker mounting hole extended inward from an inner side edge of the second end; and the second end of the hollow cone tube having an outer side edge extended outward to form a first inclined side wall, wherein a first guiding angle is included between an outer edge tangent line of the first inclined side wall and a central line of the hollow cone tube, while a first predetermined gap is defined between an outer edge of the second end of the hollow cone tube and an edge of the first opening of the first box;

a first speaker having a frame body which has a side edge adjacent to a diaphragm of the first speaker and mounted on the first speaker mounting hole, so that the frame body, a voice coil and a magnetic element in the frame body of the first speaker are received in the hollow cone tube, while the first opening, the first airflow guiding space, the vent and the first speaker are communicated with each other; and wherein the inner side surface of the first box or the outer side surface of the hollow cone tube is further provided with a plurality of light emitting elements which receive an external power to emit light in the first box, in which brightness and color of the light is varied according to sound scale, sound volume, frequency or rhythms of the sounds generated by the first speaker.

2. The audio radiation type reflective sound box structure according to claim 1, wherein the inner side surface of the first box or the outer side surface of the hollow cone tube is made of a smooth reflective material, so as to reflect the light emitted by the light emitting elements out of the first opening through the first airflow guiding space.

3. The audio radiation type reflective sound box structure according to claim 1, wherein the inner side surface of the first box or the outer side surface of the hollow cone tube is made of a smooth reflective material, so as to reflect the light emitted by the light emitting elements out of the first opening through the first airflow guiding space.

4. The audio radiation type reflective sound box structure according to claim 1, further comprising a second box which is provided with a second opening on an upper portion thereof and a second receiving space therein, wherein the second box is sleeved on the first box and connected to the bottom of the first box, and a second predetermined distance is defined between an inner side surface of the second box and an outer side surface of the first box, so as to form a second airflow guiding space between the second box and the first box.

5. The audio radiation type reflective sound box structure according to claim 4, wherein the upper portion of the first box is protruded out of the second opening of the second box, and a second predetermined gap is defined between an edge of the second opening of the second box and the edge of the first opening of the first box.

6. The audio radiation type reflective sound box structure according to claim 5, wherein a bottom of the first box is further formed with a second speaker mounting hole, and a second speaker is mounted on the second speaker mounting hole.

7. The audio radiation type reflective sound box structure according to claim 4, wherein an outer side edge of the upper portion of the first box is extended outward to form a second inclined side wall, and a second guiding angle is included between an outer edge tangent line of the second inclined side wall and the central line of the hollow cone tube.

8. The audio radiation type reflective sound box structure according to claim 5, wherein an outer side edge of the upper portion of the first box is extended outward to form a second inclined side wall, and a second guiding angle is included between an outer edge tangent line of the second inclined side wall and the central line of the hollow cone tube.

9. The audio radiation type reflective sound box structure according to claim 6, wherein an outer side edge of the upper portion of the first box is extended outward to form a second inclined side wall, and a second guiding angle is included between an outer edge tangent line of the second inclined side wall and the central line of the hollow cone tube.

10. The audio radiation type reflective sound box structure according to claim 7, wherein the inner side surface of the second box or the outer side surface of the first box is further provided with a plurality of light emitting elements which receive an external power to emit light in the second box, in which brightness and color of the light is varied according to sound scale, sound volume, frequency or rhythms of the sounds generated by the first speaker.

11. The audio radiation type reflective sound box structure according to claim 8, wherein the inner side surface of the second box or the outer side surface of the first box is further provided with a plurality of light emitting elements which receive an external power to emit light in the second box, in which brightness and color of the light is varied according to sound scale, sound volume, frequency or rhythms of the sounds generated by the first speaker.

12. The audio radiation type reflective sound box structure according to claim 9, wherein the inner side surface of the second box or the outer side surface of the first box is further provided with a plurality of light emitting elements which receive an external power to emit light in the second box, in which brightness and color of the light is varied according to sound scale, sound volume, frequency or rhythms of the sounds generated by the first speaker.

13. The audio radiation type reflective sound box structure according to claim 10, wherein the inner side surface of the second box or the outer side surface of the first box is made of smooth reflective material, so as to reflect the light emitted by the light emitting elements out of the second opening through the second airflow guiding space.

14. The audio radiation type reflective sound box structure according to claim 11, wherein the inner side surface of the second box or the outer side surface of the first box is made of smooth reflective material, so as to reflect the light emitted by the light emitting elements out of the second opening through the second airflow guiding space.

15. The audio radiation type reflective sound box structure according to claim 12, wherein the inner side surface of the second box or the outer side surface of the first box is made of smooth reflective material, so as to reflect the light emitted by the light emitting elements out of the second opening through the second airflow guiding space.

16. An audio radiation type reflective sound box structure, comprising:

a first box provided with a first opening on an upper portion thereof and a first receiving space therein;

a hollow cone tube having a first end received in the first receiving space and a second end extended out of the first opening, a first predetermined distance being defined between an inner side surface of the first box and an outer side surface of the hollow cone tube, so as to form a first airflow guiding space between the first box and the hollow cone tube; the hollow cone tube being further formed with at least one vent adjacent to the first end and a first speaker mounting hole extended inward from an inner side edge of the second end; and the second end of the hollow cone tube having an outer side edge extended outward to form a first inclined side wall, wherein a first guiding angle is included between an outer edge tangent line of the first inclined side wall and a central line of the hollow cone tube, while a first predetermined gap is defined between an outer edge of the second end of the hollow cone tube and an edge of the first opening of the first box;

a first speaker having a frame body which has a side edge adjacent to a diaphragm of the first speaker and mounted on the first speaker mounting hole, so that the frame body, a voice coil and a magnetic element in the frame body of the first speaker are received in the hollow cone tube, while the first opening, the first airflow guiding space, the vent and the first speaker are communicated with each other;

the first end of the hollow cone tube is formed with a second speaker mounting hole thereon, and a second speaker is mounted on the second speaker mounting hole, while the vent is formed adjacent to the second speaker mounting hole on the hollow cone tube; and wherein the inner side surface of the first box or the outer side surface of the hollow cone tube is further provided with a plurality of light emitting elements which receive an external power to emit light in the first box, in which brightness and color of the light is varied according to sound scale, sound volume, frequency or rhythms of the sounds generated by the first speaker.

* * * * *